US010692515B2

(12) United States Patent
Liu et al.

(10) Patent No.: US 10,692,515 B2
(45) Date of Patent: Jun. 23, 2020

(54) DEVICES FOR ACOUSTIC ECHO CANCELLATION AND METHODS THEREOF

(71) Applicant: Fortemedia, Inc., Santa Clara, CA (US)

(72) Inventors: Jianming Liu, Irvine, CA (US); Qing-Guang Liu, Sunnyvale, CA (US)

(73) Assignee: FORTEMEDIA, INC., Santa Clara, CA (US)

( * ) Notice: Subject to any disclaimer, the term of this patent is extended or adjusted under 35 U.S.C. 154(b) by 0 days.

(21) Appl. No.: 15/954,813

(22) Filed: Apr. 17, 2018

(65) Prior Publication Data

US 2019/0318756 A1 Oct. 17, 2019

(51) Int. Cl.

| | |
|---|---|
| ***G10L 21/0232*** | (2013.01) |
| ***H04R 3/04*** | (2006.01) |
| *G10L 21/0208* | (2013.01) |

(52) U.S. Cl.

CPC ..... *G10L 21/0232* (2013.01); *H04R 3/04* (2013.01); *G10L 2021/02082* (2013.01)

(58) Field of Classification Search

CPC .... H04M 9/082; H04M 9/085; H04M 11/062; H04M 2207/20; H04M 3/18; H04M 9/087; H04M 3/002; H04M 9/08; H04B 3/23; H04B 3/32; H04B 3/21; H04B 1/123; H04B 3/20; G10L 2021/02082; G10L 21/0232; G10L 21/034; G10L 21/0364; G10L 21/02; G10K 11/178; G10K 2210/3025; G10K 2210/505

USPC ..... 379/406.01, 406.08, 406.05, 406.14, 379/406.06, 406.09, 406.11, 406.12, 379/390.02; 381/66, 83, 93, 71.1, 94.1; 704/E21.002, 205

See application file for complete search history.

(56) References Cited

U.S. PATENT DOCUMENTS

| | | | | |
|---|---|---|---|---|
| 6,252,967 | B1 * | 6/2001 | Moore | H04B 1/123 381/56 |
| 2003/0021367 | A1 * | 1/2003 | Smith | H04B 1/123 375/346 |
| 2005/0089148 | A1 * | 4/2005 | Stokes, III | H04M 9/082 379/3 |
| 2005/0118956 | A1 * | 6/2005 | Haeb-Umbach | G10L 21/02 455/67.11 |

(Continued)

*Primary Examiner* — Jason R Kurr
(74) *Attorney, Agent, or Firm* — McClure, Qualey & Rodack, LLP

(57) ABSTRACT

A device for acoustic echo cancellation includes a modulator, a speaker, a microphone, a demodulator, and an adaptive filter. The modulator duplicates a far-end signal to a frequency range that is higher than the far-end signal to be a first frequency-shifted signal and generates a modulated signal according to the far-end signal and the first frequency-shifted signal. The speaker generates a sound signal according to the modulated signal. The microphone generates a microphone signal according to a near-end signal and an echo signal. The echo signal is a convolution of the sound signal with a room impulse response. The demodulator extracts a demodulated signal and an echo-reference signal from the microphone signal. The adaptive filter generates a recovered signal to recover the near-end signal according to the demodulated signal and the echo-reference signal.

20 Claims, 5 Drawing Sheets

(56) References Cited

U.S. PATENT DOCUMENTS

| | | | | |
|---|---|---|---|---|
| 2009/0185695 | A1* | 7/2009 | Marton | H04M 9/082 381/66 |
| 2010/0074455 | A1* | 3/2010 | Frauenthal | H04M 9/082 381/94.1 |
| 2011/0150240 | A1* | 6/2011 | Akiyama | H04B 1/7075 381/98 |
| 2012/0323583 | A1* | 12/2012 | Miyasaka | H04M 9/082 704/500 |
| 2013/0044873 | A1* | 2/2013 | Etter | H04M 9/082 379/406.12 |
| 2015/0011266 | A1* | 1/2015 | Feldt | H04M 9/082 455/570 |
| 2016/0171988 | A1* | 6/2016 | Vos | G01S 1/725 704/226 |
| 2016/0293181 | A1* | 10/2016 | Daniel | G10L 21/0364 |
| 2016/0309042 | A1* | 10/2016 | Kechichian | G10K 11/175 |
| 2017/0103774 | A1* | 4/2017 | Sorensen | G10L 21/0232 |
| 2017/0195496 | A1* | 7/2017 | Awano | H04B 3/232 |
| 2017/0236526 | A1* | 8/2017 | Choo | G10L 19/06 704/208 |
| 2017/0372722 | A1* | 12/2017 | Li | G10L 21/0264 |

* cited by examiner

DEVICES FOR ACOUSTIC ECHO CANCELLATION AND METHODS THEREOF

BACKGROUND OF THE INVENTION

Field of the Invention

The disclosure relates generally to methods and devices for acoustic echo cancellation.

Description of the Related Art

Acoustic echo cancellation (AEC) is used to remove an unwanted echo in hands-free communication, and it is usually done by modeling the echo path impulse with an adaptive filter and subtracting the echo from the microphone output signal.

In conventional techniques, before the speaker generates a sound signal according to a far-end signal, an echo-reference signal is generated according to the far-end signal. After the microphone receives a near-end signal including the echo of the sound signal, an adaptive filter is configured to cancel the received echo in the microphone signal by subtracting the echo-reference signal from the microphone signal to recover the near-end signal.

In some applications, the echo-reference signal may not be generated by the far-end signal, such as a TV remote. Therefore, the echo-reference signal should be generated in an alternative way to recover the received near-end signal.

BRIEF SUMMARY OF THE INVENTION

Devices and methods for acoustic echo cancellation are provided herein, which can provide a solution to problems in certain applications wherein the echo-reference signal cannot be generated by the far-end signal, such as TV remote. It is not necessary for the far-end signal to be fed into the receiving path to generate the echo-reference signal.

In an embodiment, a device for acoustic echo cancellation comprises: a modulator, a speaker, a microphone, a demodulator, and an adaptive filter. The modulator duplicates a far-end signal to a frequency range that is higher than the far-end signal to be a first frequency-shifted signal and generates a modulated signal according to the far-end signal and the first frequency-shifted signal. The speaker generates a sound signal according to the modulated signal. The microphone generates a microphone signal according to a near-end signal and an echo signal. The echo signal is a convolution of the sound signal with a room impulse response. The demodulator extracts a demodulated signal and an echo-reference signal from the microphone signal. The adaptive filter generates a recovered signal to recover the near-end signal according to the demodulated signal and the echo-reference signal.

According to an embodiment of the invention, the modulator comprises: an up-sampler, a first frequency-shifter, and a combiner. The up-sampler up-samples the far-end signal to generate an up-sampled signal. The first frequency-shifter up-converts the up-sampled signal with a carrier frequency to generate the first frequency-shifted signal. The frequency range is determined by the carrier frequency. The combiner combines the up-sampled signal and the first frequency-shifted signal to generate the modulated signal.

According to an embodiment of the invention, the first frequency-shifter up-converts the up-sampled signal to the first frequency-shifted signal by using amplitude modulation, frequency modulation, or pulse-width modulation.

According to an embodiment of the invention, the frequency range is the ultrasound frequency range.

According to an embodiment of the invention, the sound signal comprises a high-frequency sound signal and a low-frequency sound signal, and the echo signal comprises a high-frequency echo signal and a low-frequency echo signal. The high-frequency echo signal is a convolution of the high-frequency sound signal with the room impulse response, and the low-frequency echo signal is a convolution of the low-frequency sound signal with the room impulse response.

According to an embodiment of the invention, the high-frequency sound signal corresponds to the first frequency-shifted signal and the low-frequency sound signal corresponds to the up-sampled signal.

According to an embodiment of the invention, the demodulator comprises: a high-pass filter, a second frequency-shifter, and a first down-sampler. The high-pass filter extracts the high-frequency echo signal from the microphone signal. The second frequency-shifter down-converts the high-frequency echo signal with the carrier frequency to generate a second frequency-shifted signal. The first down-sampler down-samples the second frequency-shifted signal to generate the echo-reference signal.

According to an embodiment of the invention, the demodulator further comprises: a low-pass filter and a second down-sampler. The low-pass filter extracts a filtered signal from the microphone signal. The second down-sampler down-samples the filtered signal to generate the demodulated signal.

According to an embodiment of the invention, the demodulated signal comprises the low-frequency echo signal and the near-end signal.

According to an embodiment of the invention, the adaptive filter subtracts the echo-reference signal from the demodulated signal to generate the recovered signal.

In an embodiment, a method for acoustic echo cancellation, comprises: duplicating a far-end signal to a frequency range that is higher than the far-end signal to be a first frequency-shifted signal; generating a modulated signal according to the far-end signal and the first frequency-shifted signal; using a speaker to generate a sound signal according to the modulated signal; using a microphone to generate a microphone signal according to a near-end signal and an echo signal, wherein the echo signal is a convolution of the sound signal with a room impulse response; extracting a demodulated signal and an echo-reference signal from the microphone signal; and using an adaptive filter to generate a recovered signal to recover the near-end signal according to the demodulated signal and the echo-reference signal.

According to an embodiment of the invention, the step of duplicating the far-end signal to the frequency range that is higher than the far-end signal to be the first frequency-shifted signal comprises: up-sampling the far-end signal to generate an up-sampled signal; and up-converting the up-sampled signal with a carrier frequency to generate the first frequency-shifted signal, wherein the frequency range is determined by the carrier frequency.

According to an embodiment of the invention, the up-sampled signal is up-converted with the carrier frequency by using amplitude modulation, frequency modulation, or pulse-width modulation.

According to an embodiment of the invention, the step of generating the modulated signal according to the far-end signal and the first frequency-shifted signal comprises: combining the up-sampled signal and the first frequency-shifted signal to generate the modulated signal.

According to an embodiment of the invention, the frequency range is the ultrasound frequency range.

According to an embodiment of the invention, the sound signal comprises a high-frequency sound signal and a low-frequency sound signal, and the echo signal comprises a high-frequency echo signal and a low-frequency echo signal. The high-frequency echo signal is a convolution of the high-frequency sound signal with the room impulse response, and the low-frequency echo signal is a convolution of the low-frequency sound signal with the room impulse response.

According to an embodiment of the invention, the high-frequency sound signal corresponds to the first frequency-shifted signal and the low-frequency sound signal corresponds to the up-sampled signal.

According to an embodiment of the invention, the step of extracting the demodulated signal and the echo-reference signal from the microphone signal comprises: extracting the high-frequency echo signal from the microphone signal; down-converting the high-frequency echo signal with the carrier frequency to generate a second frequency-shifted signal; and down-sampling the second frequency-shifted signal to generate the echo-reference signal.

According to an embodiment of the invention, the step of extracting the demodulated signal and the echo-reference signal from the microphone signal further comprises: extracting a filtered signal from the microphone signal, wherein the filter signal comprises the low-frequency echo signal and the near-end signal; and down-sampling the filtered signal to generate the demodulated signal.

According to an embodiment of the invention, the step of using the adaptive filter to recover the near-end signal from the demodulated signal according to the echo-reference signal further comprises: subtracting the echo-reference signal from the demodulated signal to generate the recovered signal.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
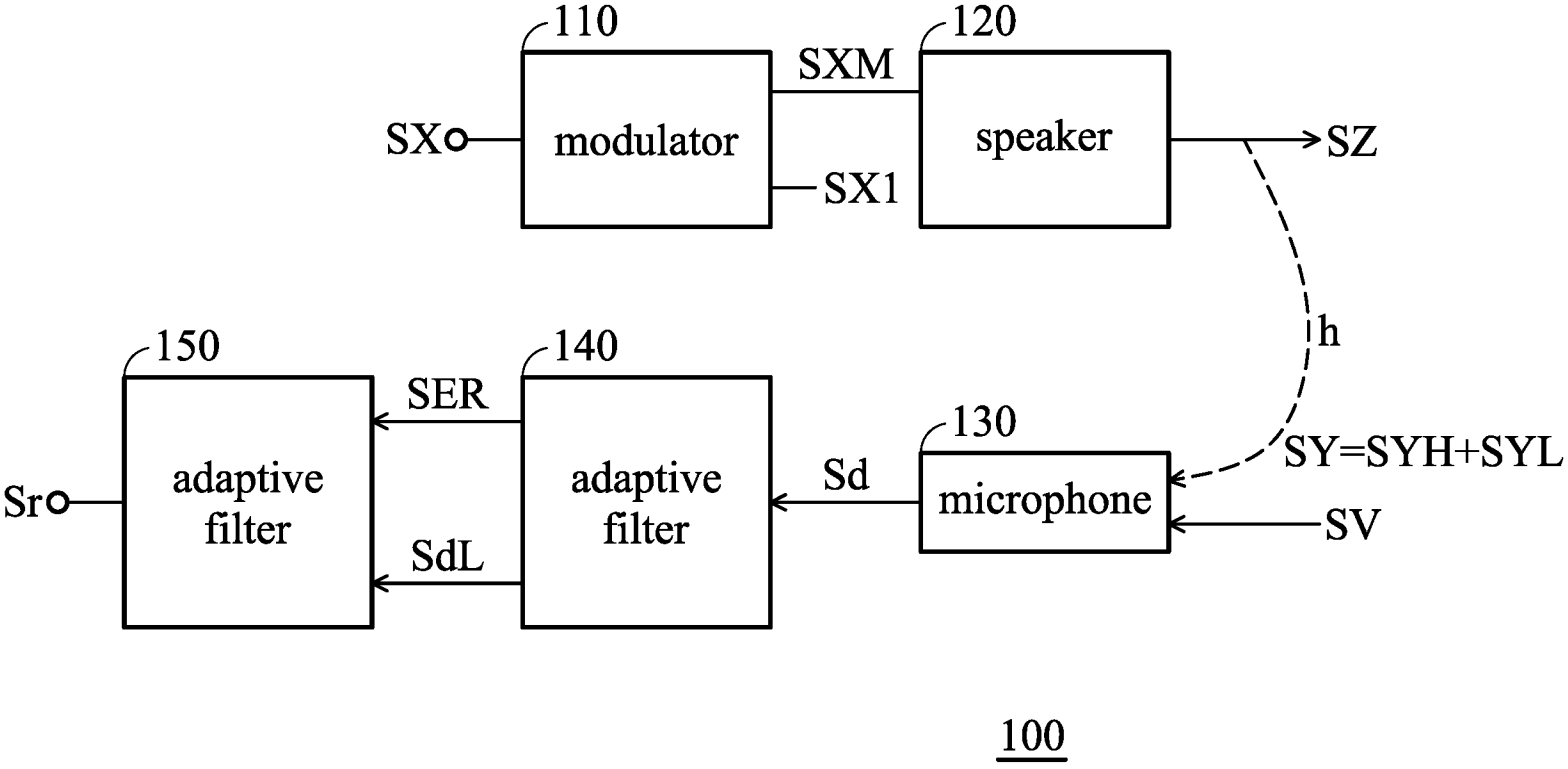
FIG. 1 is a block diagram of a device for acoustic echo cancellation in accordance with an embodiment of the invention.

This description is made for the purpose of illustrating the general principles of the invention and should not be taken in a limiting sense. In addition, the present disclosure may repeat reference numerals and/or letters in the various examples. This repetition is for the purpose of simplicity and clarity and does not in itself dictate a relationship between the various embodiments and/or configurations discussed. The scope of the invention is best determined by reference to the appended claims.

It should be understood that the following disclosure provides many different embodiments, or examples, for implementing different features of the application. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a feature on, connected to, and/or coupled to another feature in the present disclosure that follows may include embodiments in which the features are formed in direct contact, and may also include embodiments in which additional features may be formed interposing the features, such that the features may not be in direct contact.

FIG. 1 is a block diagram of a device for acoustic echo cancellation in accordance with an embodiment of the invention. As shown in FIG. 1, the device 100 for acoustic echo cancellation includes a modulator 110, a speaker 120, a microphone 130, a demodulator 140, and an adaptive filter 150.

The modulator 110 is configured to duplicate the far-end signal SX to a frequency range that is higher than the far-end signal SX to be a first frequency-shifted signal SX1 and to generate a modulated signal SXM according to the far-end signal SX and the first frequency-shifted signal SX1. The speaker 120 then generates a sound signal SZ according to the modulated signal SXM.

The microphone 130 is configured to receive a near-end signal SV with an echo signal SY to generate a microphone signal Sd. According to an embodiment of the invention, the echo signal SY is a convolution of the sound signal SZ and a room impulse response H. Since the near-end signal SV is received with the echo signal SY, the echo signal SY should be removed from the microphone signal Sd to recover the near-end signal SV.

The demodulator 140 extracts a demodulated signal SdL and an echo-reference signal SER from the microphone signal Sd. The adaptive filter 150 generates a recovered signal Sr to recover the near-end signal SV according to the demodulated signal SdL and the echo-reference signal SER.

Figure 2:
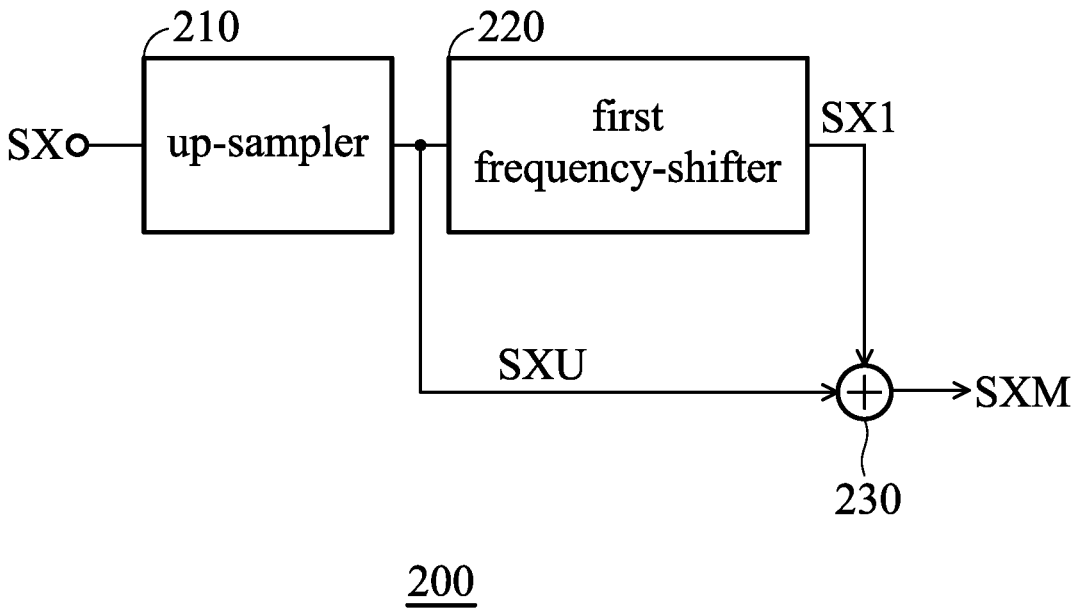
FIG. 2 is a block diagram of the modulator 110 in FIG. 1 in accordance with an embodiment of the invention.

FIG. 2 is a block diagram of the modulator 110 in FIG. 1 in accordance with an embodiment of the invention. As shown in FIG. 2, the modulator 200 includes an up-sampler 210, a first frequency-shifter 220, and a combiner 230, in which the modulator 200 corresponds to the modulator 110 in FIG. 1.

The up-sampler 210 up-samples the far-end signal SX to generate an up-sampled signal SXU. The first frequency-shifter 220 up-converts the up-sampled signal SXU with a carrier frequency to generate the first frequency-shifted signal SX1, in which the frequency range is determined by the carrier frequency.

According to an embodiment of the invention, the frequency range that the up-sampled signal SXU is up-converted to is the ultrasound frequency range. According to other embodiments of the invention, the frequency range can be any frequency range that is higher than the frequency range of the far-end signal SX and the up-sampled signal SXU. According to some embodiments of the invention, the first frequency-shifter 220 up-converts the up-sampled signal SXU to the first frequency-shifted signal SX1 by using amplitude modulation, frequency modulation, or pulse-width modulation.

Figure 3A:
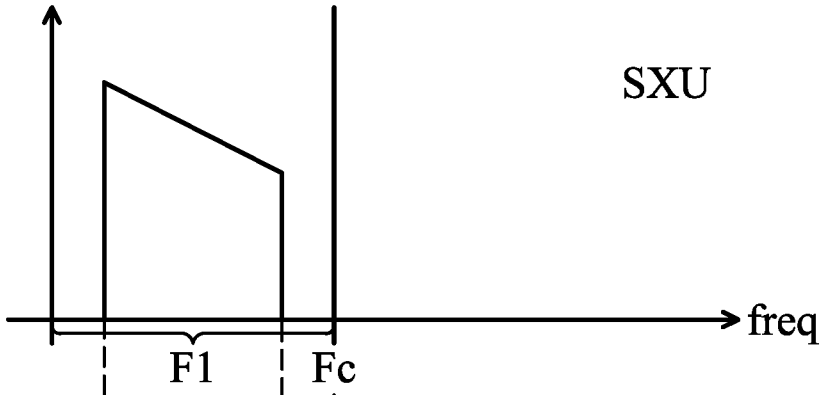
FIGS. 3A-3C respectively illustrate the up-sampled signal SXU, the first frequency-shifted signal SX1, and the modulated signal SXM in accordance with an embodiment of the invention.
Figure 3B:
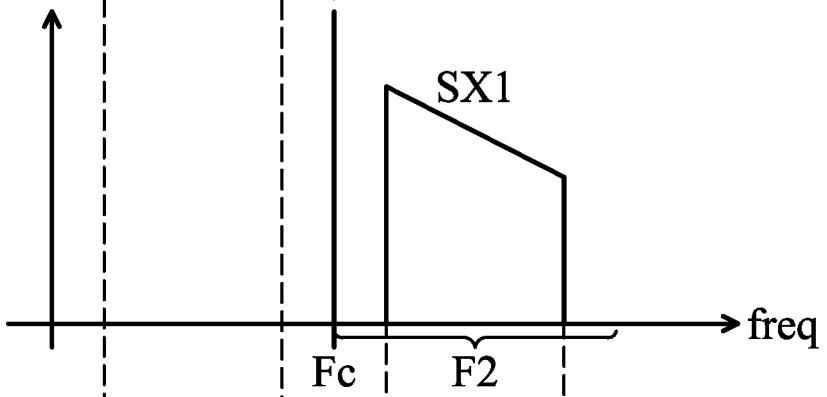
Figure 3C:
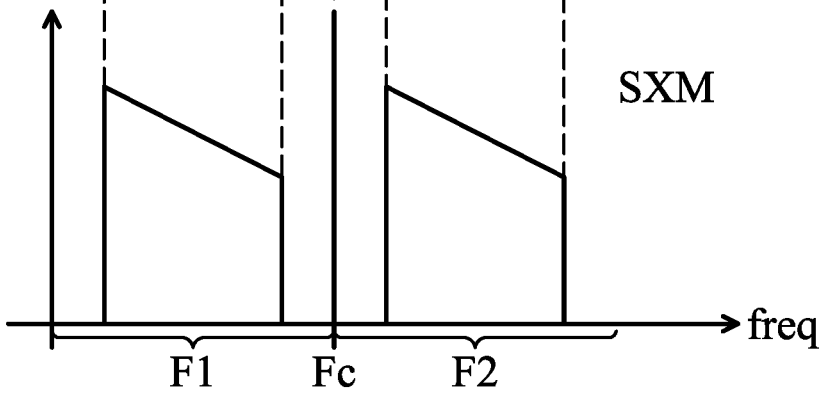

The combiner 230 combines the up-sampled signal SXU and the first frequency-shifted signal SX1 to generate the modulated signal SXM. FIGS. 3A-3C respectively illustrate the up-sampled signal SXU, the first frequency-shifted signal SX1, and the modulated signal SXM in accordance with an embodiment of the invention.

As shown in FIG. 3A, the up-sampled signal SXU is in the first frequency range F1. According to an embodiment of the invention, the far-end signal SX is also in the first frequency range F1. According to an embodiment of the invention, the first frequency range F1 is the speech frequency range.

As shown in FIG. 3B, after the up-sampled signal SXU is up-converted with the carrier frequency Fc, the first frequency-shifted signal SX1 is in the second frequency range F2. According to an embodiment of the invention, the second frequency range F2 is the ultrasound frequency range. According to other embodiments of the invention, the second frequency range may be any frequency range that is higher than the first frequency range F1, which is related to the carrier frequency Fc.

When the combiner 230 combines the up-sampled signal SXU and the first frequency-shifted signal SX1 to generate the modulated signal SXM, the modulated signal SXM is shown in FIG. 3C, which is in both the first frequency range F1 and the second frequency range F2.

According to an embodiment of the invention, since the modulated signal SXM includes a high-frequency part (corresponding to the second frequency range F2) and a low-frequency part (corresponding to the first frequency part F1), the sound signal SZ in FIG. 1 also includes a high-frequency sound signal (corresponding to the first frequency-shifted signal SX1) and a low-frequency sound signal (corresponding to the up-sampled signal SXU). According to an embodiment of the invention, the high-frequency sound signal corresponds to the first frequency-shifted signal SX1, and the low-frequency sound signal corresponds to the up-sampled signal SXU.

In addition, the echo signal SY in FIG. 1 includes a high-frequency echo signal SYH and a low-frequency echo signal SYL which correspond to the high-frequency sound signal and the low-frequency sound signal respectively. According to an embodiment of the invention, the high-frequency echo signal SYH is a convolution of the high-frequency sound signal with the room impulse response H, and the low-frequency echo signal SYL is a convolution of the low-frequency sound signal with the room impulse response H. The high-frequency echo signal SYH and the low-frequency echo signal SYL will be discussed in the following paragraphs.

Figure 4:
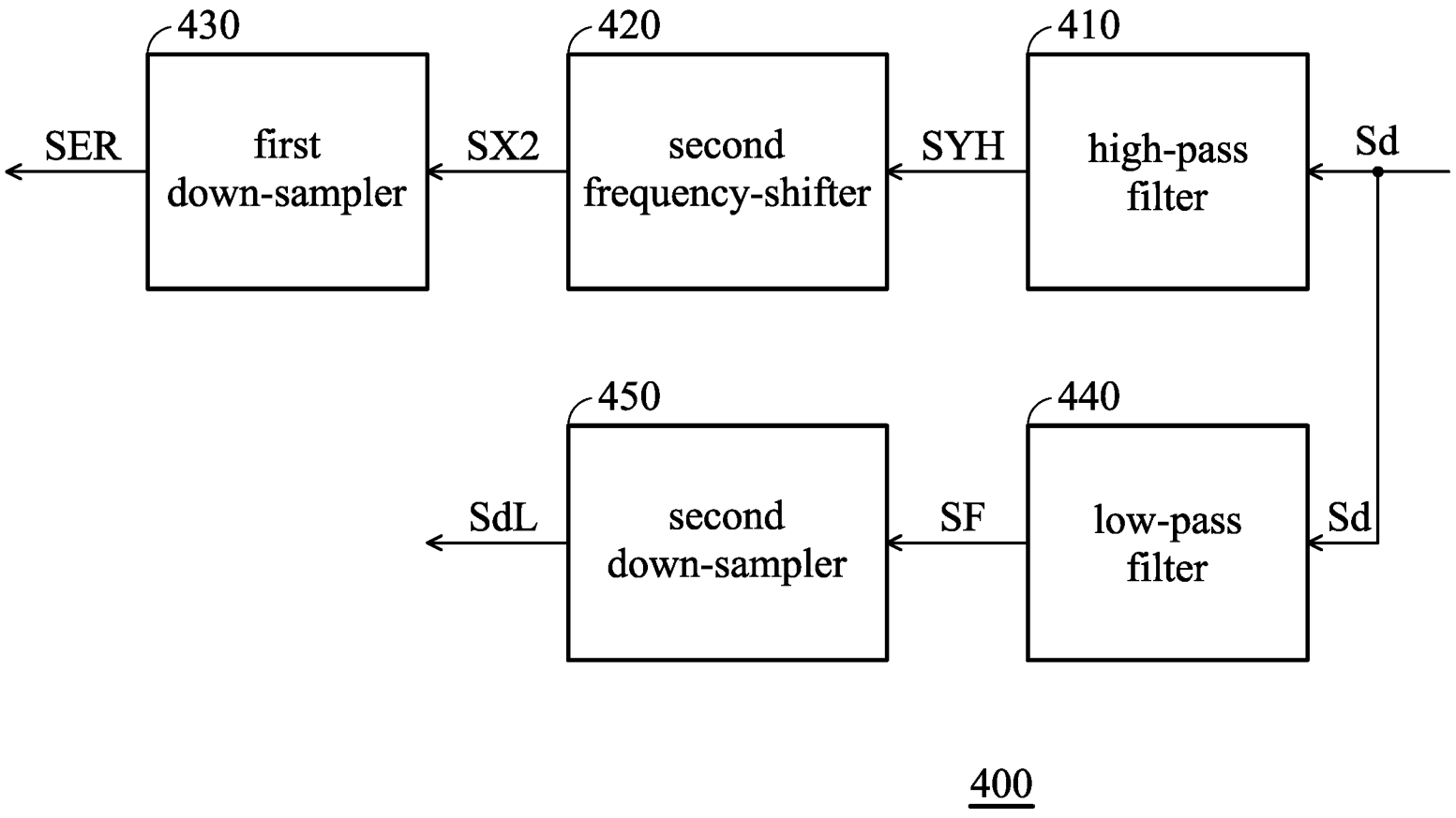
FIG. 4 shows a block diagram of the demodulator 140 in FIG. 1 in accordance with an embodiment of the invention.

FIG. 4 shows a block diagram of the demodulator 140 in FIG. 1 in accordance with an embodiment of the invention. As shown in FIG. 4, the demodulator 400 includes a high-pass filter 410, a second frequency-shifter 420, a first down-sampler 430, a low-pass filter 440, and a second down-sampler 450.

The high-pass filter 410 extracts, with a proper cut-off frequency, the high-frequency echo signal SYH from the microphone signal Sd received by the microphone 130 in FIG. 1. The second frequency-shifter 420 down-converts the high-frequency echo signal SYH with the carrier frequency Fc in FIGS. 3A-3C to generate a second frequency-shifted signal SX2. The first down-sampler 430 down-samples the second frequency-shifted signal SX2 to generate the echo-reference signal SER.

The low-pass filter 440 extracts a filtered signal SF from the microphone signal Sd. According to an embodiment of the invention, the filter signal SF includes the low-frequency echo signal SYL and the near-end signal SV received by the microphone 130 in FIG. 1. The second down-sampler 450 down-samples the filtered signal SF to generate the demodulated signal SdL.

Referring to FIG. 1, the adaptive filter 150 subtracts the echo-reference signal SER from the demodulated signal SdL to generate the recovered signal Sr for recovering the near-end signal SV received by the microphone 130 in FIG. 1.

As illustrated in FIGS. 3A-3C, the up-sampled signal SXU is up-converted with the carrier frequency Fc, and the modulated signal SXM is generated by the up-sampled signal SXU combined with the first frequency-shifted signal SX1. Namely, the high-frequency echo signal SYH is much similar to the low-frequency echo signal SYL since the room impulse response H may be varied with different frequency.

Since the near-end signal SV and the low-frequency echo signal SYL are in the same frequency range, the demodulator 140 in FIG. 1, especially the high-pass filter 410, the second frequency-shifter 420, and the first down-sampler 430, extracts and down-converts the high-frequency echo signal SYH, which is in the second frequency range F2 as shown in FIGS. 3A-3C, from the microphone signal Sd to generate the echo-reference signal SER. Namely, the echo-reference signal SER corresponds to the high-frequency echo signal SYH.

In addition, the demodulator 140 in FIG. 1, especially the low-pass filter 440 and the second down-sampler 450, extracts the near-end signal SV combined with the low-frequency echo signal SYL, which is in the first frequency range F1 as shown in FIGS. 3A-3C, from the microphone signal Sd to generate the demodulated signal SdL.

When the adaptive filter 150 in FIG. 1 subtracts the echo-reference signal SER from the demodulated signal SdL, the low-frequency echo signal SYL should be eliminated and the near-end signal SV is then obtained.

Figure 5:
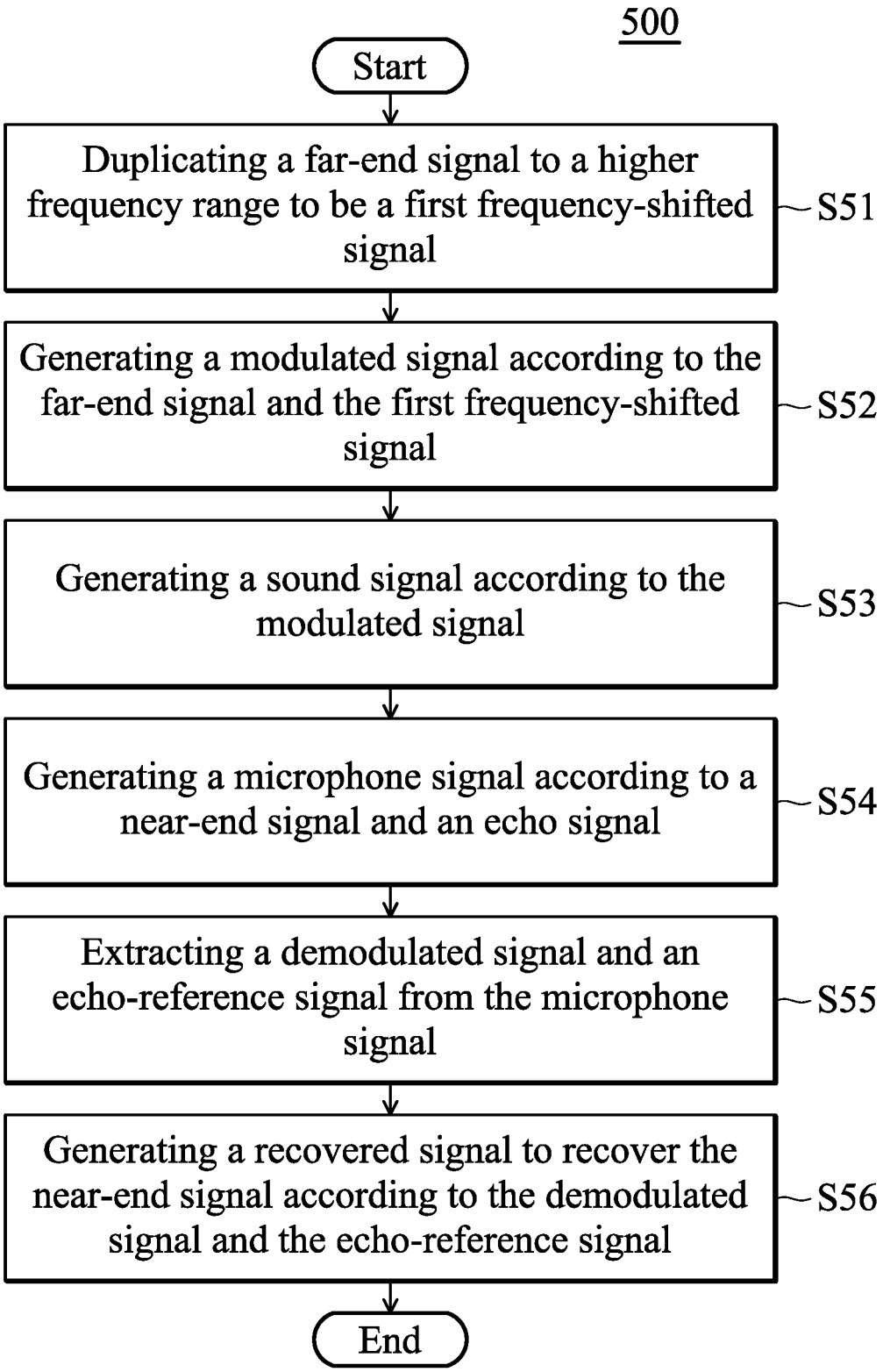
FIG. 5 is a flow chart of a method for acoustic echo cancellation in accordance with an embodiment of the invention.

FIG. 5 is a flow chart of a method for acoustic echo cancellation in accordance with an embodiment of the invention. In the following description of the method 500, FIGS. 1-4 will be accompanied for explanation.

As shown in FIG. 5, the modulator 110 duplicates the far-end signal SX to a higher frequency range to be the first frequency-shifted signal SX1 (Step S51). According to an embodiment of the invention, before generating the first frequency-shifted signal SX1, the up-sampler 210 in FIG. 2 up-samples the far-end signal SX to generate the up-sampled signal SXU, and the first frequency-shifter 220 up-converts the up-sampled signal SXU to generate the first frequency-shifted signal SX1.

Then, the modulator 110 generates a modulated signal SXM according to the far-end signal SX and the first frequency-shifted signal SX1 (Step S52). The speaker 120 generates a sound signal SZ according to the modulated signal SXM (Step S53).

The microphone 130 generates a microphone signal Sd according to a near-end signal SV and an echo signal SY (Step S54). According to an embodiment of the invention, the echo signal SY is a convolution of the sound signal SZ with a room impulse response H. According to an embodiment of the invention, the echo signal SY includes a high-frequency echo signal SYH and a low-frequency echo signal SYL.

The demodulator 140 extracts a demodulated signal SdL and an echo-reference signal SER from the microphone signal (Step S55). According to an embodiment of the invention, the echo-reference signal SER corresponds to the high-frequency echo signal SYH, and the demodulated signal SdL includes the low-frequency echo signal SYL and the near-end signal SV.

The adaptive filter 150 extracts the near-end signal SV according to the demodulated signal SdL the echo-reference signal SER (Step S56). According to an embodiment of the invention, the adaptive filter 150 subtracts the echo-reference signal SER from the demodulated signal SdL to remove the low-frequency echo signal SYL in the demodulated signal SdL such that the near-end signal is therefore recovered.

The devices and methods for acoustic echo cancellation are provided herein, which can provide a solution to problems generating the echo-reference signal with the far-end signal, such as a TV remote. It is not necessary for the far-end signal to be fed into the receiving path to generate the echo-reference signal.

While the invention has been described by way of example and in terms of preferred embodiment, it should be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A device for acoustic echo cancellation, comprising:

a modulator, duplicating a far-end signal to a frequency range that is higher than the far-end signal to be a first frequency-shifted signal and generating a modulated signal according to the far-end signal and the first frequency-shifted signal;

a speaker, generating a sound signal according to the modulated signal;

a microphone, generating a microphone signal according to a near-end signal and an echo signal, wherein the echo signal is a convolution of the sound signal with a room impulse response;

a demodulator, extracting a demodulated signal and an echo-reference signal from the microphone signal; and an adaptive filter, generating a recovered signal to recover the near-end signal according to the demodulated signal and the echo-reference signal.

2. The device of claim 1, wherein the modulator comprises:

an up-sampler, up-sampling the far-end signal to generate an up-sampled signal;

a first frequency-shifter, up-converting the up-sampled signal with a carrier frequency to generate the first frequency-shifted signal, wherein the frequency range is determined by the carrier frequency; and a combiner, combining the up-sampled signal and the first frequency-shifted signal to generate the modulated signal.

3. The device of claim 2, wherein the first frequency-shifter up-converts the up-sampled signal to the first frequency-shifted signal by using amplitude modulation, frequency modulation, or pulse-width modulation.

4. The device of claim 2, wherein the frequency range is an ultrasound frequency range.

5. The device of claim 2, wherein the sound signal comprises a high-frequency sound signal and a low-frequency sound signal, and the echo signal comprises a high-frequency echo signal and a low-frequency echo signal, wherein the high-frequency echo signal is a convolution of the high-frequency sound signal with the room impulse response, and the low-frequency echo signal is a convolution of the low-frequency sound signal with the room impulse response.

6. The device of claim 5, wherein the high-frequency sound signal corresponds to the first frequency-shifted signal and the low-frequency sound signal corresponds to the up-sampled signal.

7. The device of claim 5, wherein the demodulator comprises:

a high-pass filter, extracting the high-frequency echo signal from the microphone signal;

a second frequency-shifter, down-converting the high-frequency echo signal with the carrier frequency to generate a second frequency-shifted signal; and a first down-sampler, down-sampling the second frequency-shifted signal to generate the echo-reference signal.

8. The device of claim 7, wherein the demodulator further comprises:

a low-pass filter, extracting a filtered signal from the microphone signal; and a second down-sampler, down-sampling the filtered signal to generate the demodulated signal.

9. The device of claim 8, wherein the demodulated signal comprises the low-frequency echo signal and the near-end signal.

10. The device of claim 9, wherein the adaptive filter subtracts the echo-reference signal from the demodulated signal to generate the recovered signal.

11. A method for acoustic echo cancellation, comprising:

duplicating a far-end signal to a frequency range that is higher than the far-end signal to be a first frequency-shifted signal;

generating a modulated signal according to the far-end signal and the first frequency-shifted signal;

using a speaker to generate a sound signal according to the modulated signal;

using a microphone to generate a microphone signal according to a near-end signal and an echo signal, wherein the echo signal is a convolution of the sound signal with a room impulse response;

extracting a demodulated signal and an echo-reference signal from the microphone signal; and using an adaptive filter to generate a recovered signal to recover the near-end signal according to the demodulated signal and the echo-reference signal.

12. The method of claim 11, wherein the step of duplicating the far-end signal to the frequency range that is higher than the far-end signal to be the first frequency-shifted signal comprises:

up-sampling the far-end signal to generate an up-sampled signal; and up-converting the up-sampled signal with a carrier frequency to generate the first frequency-shifted signal, wherein the frequency range is determined by the carrier frequency.

13. The method of claim 12, wherein the up-sampled signal is up-converted with the carrier frequency by using amplitude modulation, frequency modulation, or pulse-width modulation.

14. The method of claim 12, wherein the step of generating the modulated signal according to the far-end signal and the first frequency-shifted signal comprises:

combining the up-sampled signal and the first frequency-shifted signal to generate the modulated signal.

15. The method of claim 12, wherein the frequency range is the ultrasound frequency range.

16. The method of claim 12, wherein the sound signal comprises a high-frequency sound signal and a low-frequency sound signal, and the echo signal comprises a high-frequency echo signal and a low-frequency echo signal, wherein the high-frequency echo signal is a convolution of the high-frequency sound signal with the room impulse response, and the low-frequency echo signal is a convolution of the low-frequency sound signal with the room impulse response.

17. The method of claim 16, wherein the high-frequency sound signal corresponds to the first frequency-shifted signal and the low-frequency sound signal corresponds to the up-sampled signal.

18. The method of claim 16, wherein the step of extracting the demodulated signal and the echo-reference signal from the microphone signal comprises:

extracting the high-frequency echo signal from the microphone signal;

down-converting the high-frequency echo signal with the carrier frequency to generate a second frequency-shifted signal; and down-sampling the second frequency-shifted signal to generate the echo-reference signal.

19. The method of claim 18, wherein the step of extracting the demodulated signal and the echo-reference signal from the microphone signal further comprises:

extracting a filtered signal from the microphone signal, wherein the filter signal comprises the low-frequency echo signal and the near-end signal; and down-sampling the filtered signal to generate the demodulated signal.

20. The method of claim 19, wherein the step of using the adaptive filter to recover the near-end signal from the demodulated signal according to the echo-reference signal further comprises:

subtracting the echo-reference signal from the demodulated signal to generate the recovered signal.

* * * * *